United States Patent [19]

Honjo et al.

[11] 3,976,808

[45] Aug. 24, 1976

[54] IMAGING SYSTEMS

[75] Inventors: Satoru Honjo; Yasuo Tamai; Nobuo Tsuji, all of Tokyo, Japan

[73] Assignee: Xerox Corporation, Stamford, Conn.

[22] Filed: May 21, 1975

[21] Appl. No.: 579,339

Related U.S. Application Data

[62] Division of Ser. No. 364,848, May 29, 1973, Pat. No. 3,926,825.

[52] U.S. Cl. ..... 427/17; 427/221; 427/222

[51] Int. Cl.[2] ..... B05D 1/06

[58] Field of Search ..... 427/17, 221, 222; 252/62.1

[56] References Cited

UNITED STATES PATENTS

| | | | |
|---|---|---|---|
| 3,438,904 | 4/1969 | Wagner | 252/62.1 |
| 3,585,140 | 6/1971 | Machida et al. | 252/62.1 |
| 3,668,127 | 6/1972 | Machida et al. | 252/62.1 |
| 3,729,419 | 4/1973 | Honjo et al. | 252/62.1 |
| 3,819,367 | 6/1974 | Chatterji et al. | 252/62.1 X |

*Primary Examiner*—Ronald H. Smith
*Assistant Examiner*—Stuart D. Frenkel

[57] ABSTRACT

Liquid developer compositions for use in developing a recording surface bearing an electrostatic latent image comprising finely divided colored marking particles substantially homogeneously dispersed in a carrier liquid, the colored marking particles comprising pigment particles substantially completely covered with a positive charge adjusting agent comprising a polymer of alkyl methacrylate-styrene-vinyltriethoxysilane. Imaging processes employing said liquid developer compositions are also disclosed.

10 Claims, No Drawings

IMAGING SYSTEMS

This application is a divisional application of copending application Ser. No. 364,848, filed on May 29, 1973, now U.S. Pat. No. 3,926,825.

BACKGROUND OF THE INVENTION

This invention relates to imaging systems and more particularly to improved electrophotographic developer materials.

The formation and development of images on the surface of photoconductive materials by electrostatic means is well known. The basic electrostatographic process, as taught by C. F. Carlson in U.S. Pat. No. 2,297,691, involves placing a uniform electrostatic charge on a photoconductive insulating layer, exposing the layer to a light and shadow image to dissipate the charge on the areas of the layer exposed to the light and developing the resulting electrostatic latent image by depositing on the image a finely divided electroscopic material referred to in the art as "toner." The toner will normally be attracted to those areas of the layer which retain a charge, thereby forming a toner image corresponding to the electrostatic latent image. This powder image may then be transferred to a support surface such as paper. The transferred image may be subsequently permanently affixed to a support surface as by heat. Instead of latent image formation by uniformly charging the photoconductive layer and then exposing the layer to a light and shadow image, one may form the latent image directly by charging the layer in image configuration. The powder image may be fixed to the photoconductive layer if elimination of the powder image transfer step is desired. Other suitable fixing means such as solvents or overcoating treatment may be substituted.

Similar methods are known for applying the electroscopic particles to the electrostatic latent image to be developed. Included within this group are the "cascade" development techniques disclosed by E. N. Wise in U.S. Pat. No. 2,618,552; the "powder cloud" technique disclosed by C. F. Carlson in U.S. Pat. No. 2,221,776; and the "magnetic brush" process disclosed, for example, in U.S. Pat. No. 2,874,063.

Development of an electrostatic latent image may also be achieved with liquid rather than dry developer materials. In conventional liquid development, more commonly referred to as electrophoretic development, an insulating liquid vehicle having finely divided solid material dispersed therein contacts the imaging surface in both charged and uncharged areas. Under the influence of the electric field associated with the charged image pattern, the suspended particles migrate toward the charged portions of the imaging surface separating out of the insulating liquid. This electrophoretic migration of charged particles results in the deposition of the charged particles on the imaging surface in image configuration. Electrophoretic development of an electrostatic latent image may, for example, be obtained by flowing the liquid developer over the image bearing surface, by immersing the imaging surface in a pool of the developer or by presenting the liquid developer on a smooth surface roller and moving the roller against the imaging surface.

Thus, in an electrophoretic development system, the entire imaging surface is contacted with the liquid developer with the charged particles separating from the carrier liquid and migrating to the charged field or image portions. The particles strongly adhere to the imaging surface by means of vanderWaals forces since the particles frequently come within about 500 angstroms of the imaging surface. Consequently, electrophoretic liquid development is particularly suitable for reproduction of continuous-tone images to produce images of high quality. Further, electrophoretic development methods may provide excellent results when applying various liquid developers of different colors successively to an electrophotographic photosensitive layer comprised of, for example, photoconductive zinc oxide which is subsequently developed to produce a multi-colored image.

In general, liquid developer compositions are prepared by suspending finely divided particles having charges of the appropriate polarity and magnitude in a highly dielectric carrier solution. To obtain excellent electrophotographic characteristics, it is generally required that the magnitude of the charges on the suspended particles does not vary with respect to the carrier solution or that the polarity of the charges is not reversed even during a prolonged storage period. Therefore, when finely divided particles in a liquid developer composition have positive charges and the developer composition is applied to an electrostatic latent image bearing negative charges, positive development results, and when applying such a composition to a positively charged latent image, reversal development results.

When finely divided toner particles made of a composition which is insoluble in a carrier solution are dispersed in the carrier liquid, these particles generally have some potential against the carrier liquid. The polarity and the magnitude of charges are usually determined depending upon the conditions of the particle surface, the molecules absorbed onto the particle surface, and the like. When particles are dispersed in a solvent such as a hydrocarbon, their polarity is usually specific to themselves. For example, pigments such as Phthalocyanine Blue, Brilliant Carmine 6B, Hansa Yellow, natural and synthetic resins such as rosin, gelatin, albumin, casein, cellulose acetate, polyvinyl acetate, polyamides, nylon, and polymethylmethacrylate have positive charges. On the other hand, pigments such as sulphur, selenium, Phthalocyanine Green, lead chromate, nitrocellulose, copolymers of vinyl chloride, polyvinylidene chloride, polyvinylidene fluoride, chlorinated polypropylene, and phenol-modified alkyd resins provide negative charges on contact with solvents of hydrocarbon systems. It has been found experimentally that the polarities of these charges are almost coincidental with the materials in a triboelectric series.

It is preferable when preparing liquid developer compositions having positive polarities for development of negative electrostatic latent images borne on a zinc oxide photosensitive layer to employ pigments or resin materials which provide positive polarities as described above. For instance, when preparing a carmine developer, it is preferable to disperse Brilliant Carmine 6B into kerosene. However, in liquid developer compositions prepared by suspending and dispersing only a pigment, the charges of the particles are often unstable under storage conditions for a prolonged period. Moreover, when developing a multi-colored image with developer compositions having different colors, it is very difficult to provide developer compositions prepared by suspending only pigments and to provide equal magnitudes of charges and to the suspended particles. Consequently, a charge adjusting agent is usually added to these compositions.

The charge adjusting agent is usually first added to the pigment and mixed sufficiently therewith and the resulting mixture is dispersed in a carrier liquid. When the charge adjusting agent is soluble in the carrier liquid, the mixture is rather easily dispersed. However, a liquid developer composition prepared as described above usually has poor storage properties, and the charges of the dispersed particles are apt to change with time. The result will be that the charge adjusting agent absorbed on the surface of the particles may be gradually released into the carrier liquid. This defect may be eliminated by using a charge adjusting agent which is insoluble in the carrier liquid. That is, the charge adjusting agent will remain on the surface of the pigment, thus the dispersed particles will retain a constant charge as against the carrier liquid since they are always combined with the charge adjusting agent. When employing a charge adjusting agent which is insoluble in a carrier solvent, it is rather difficult, however, to prepare dispersed particles which are sufficiently finely divided.

As a charge adjusting agent which is insoluble in a carrier liquid and provides a positive polarity, ethylcellulose has been so employed. However, even though ethylcellulose provides somewhat stable positive charges in a carrier liquid, there are certain disadvantages in employing this material. That is, it is sparingly soluble in solvents such as aromatic or chlorinated hydrocarbons and even when it dissolves, it frequently results in high viscosities. Thus, the viscosity of a paste or mixture comprising such a charge adjusting agent and pigment particles is increased to result in difficulty in dispersing the paste into a carrier liquid.

As a method of preparing liquid developer compositions employing a charge adjusting agent, there is one wherein a mixture, for example, composed of a pigment and a charge adjusting agent, generally a resin, is kneaded in a carrier liquid and subsequently pulverized. In such a method, however, dispersed particles of a fine particle size are rarely produced since in the pulverizing process the pigment is exposed and apt to contact directly with the carrier liquid. There is also another method wherein particles of a small particle size in a mixture consisting of a pigment and a charge adjusting agent may be prepared by spray drying and then dispersed in a carrier liquid. However, when employing this method, it is difficult to make the particles themselves and it is also difficult to redisperse the primary particles in the carrier liquid since they tend to mass together and coagulate.

It is, therefore, clear that there is a continuing need for an improved liquid developer composition.

SUMMARY OF THE INVENTION

It is, therefore, an object of this invention to provide liquid developer compositions which overcome the above noted deficiencies.

It is another object of this invention to provide novel liquid developer compositions containing a positive charge adjusting agent.

It is another object of this invention to provide liquid developer compositions which provide stable positive charges under prolonged storage conditions.

It is another object of this invention to provide liquid developer compositions which produce images having improved resolution and density.

It is another object of this invention to provide liquid developer compositions which are superior to known liquid developer compositions.

The above objects and others are accomplished, generally speaking, by providing a liquid developer composition for electrophotography wherein finely divided toner particles are substantially completely covered with a positive charge adjusting agent which is insoluble in the carrier liquid and wherein the toner particles are homogenously dispersed in the carrier liquid.

Generally speaking, the liquid developer compositions of this invention may be prepared by the following steps:

(1) a mixture comprising a charge adjusting agent which is insoluble in the carrier liquid and a pigment is prepared using an appropriate solvent; (2) the resulting pasty mixture is dispersed in the carrier liquid by such means as high speed agitation and supersonic wave dispersion.

The solvent to be used in Step (1) above is preferably one which is a good solvent for both the charge adjusting agent and a resin which is soluble in the carrier liquid. The solvent should be miscible with the carrier liquid. In preparing the paste in Step (1), the pigment should be dispersed as finely as possible. For this purpose, the pigment preferably exists merely in the state of a primary particle. Pigments prepared by a flushing process are, therefore, preferable. When adding the paste obtained in Step (1) to the carrier liquid, the solvent employed therein and a resin soluble in the carrier liquid dissolve into the carrier liquid to result in dividing the paste into fine particles, and simultaneously the pigment particles are individually coated with the charge adjusting agent. Since the solvent used for the preparation of the paste is ultimately mixed into the liquid developer composition, those solvent materials which deteriorate the electrical characteristics of the liquid developer are not preferable. Therefore, it is preferred that the solvent to be used in Step (1) possess a high electrical resistance.

In accordance with the present invention, it has been found that terpolymers of methylmethacrylate-styrene-vinyltriethoxysilane and their analogs provide a charge adjusting agent which has excellent solubility in nonpolar solvents having high electrical resistances and which have good miscibility with a resin which is soluble in the carrier solvent to provide liquid developer compositions having stable positive charges. These terpolymers have been found to have good solubility in aromatic hydrocarbons, chlorinated hydrocarbons, and chloro-fluorinated hydrocarbons; and are insoluble in kerosene, cyclohexane, and isoparaffin which are commonly used as carrier liquids, and further provide strong positive charges in liquid developer compositions.

Any suitable carrier solvent may be used in the liquid developer compositions of the present invention. The carrier solvents to be used in the liquid developer compositions of this invention preferably have an electrical resistance greater than about $10^{10}$ ohms-cm and a dielectric constant less than about 3.5. It is preferred not to use an aromatic hydrocarbon alone, though such meets the above requirements, because such a solvent generally dissolves the charge adjusting agent, a terpolymer of alkyl-methacrylate-styrene-vinyltriethoxysilane, from the surface of the coated toner particles. Particularly preferred carrier solvents include linear aliphatic hydrocarbons such as kerosene, saturated alicyclic hydrocarbons such as cyclohexane, and branched aliphatic hydrocarbons such as isoparaffin. To reduce the flammability of such solutions, a small amount of chloro-fluorinated hydrocarbon may be added, unless it dissolves the charge adjusting agent.

A small amount of a dispersion assistant may be added to the carrier solvent system. Such a dispersion assistant may be desirable to aid in redispersing the aforementioned paste. As dispersion assistants, various vegetable oils and vegetable oil-modified alkyd resins may be employed. The amount of dispersion assistant to be added is generally in the range of from about 0.5 to about 30% by weight based on the carrier liquid. When adding a substantial amount of such a dispersion assistant, the viscosity of the carrier liquid generally increases to delay the speed of development.

The dispersants are incorporated to provide substantially uniform dispersion of the colorant material in the liquid developer. The dispersants further function to reduce colorant agglomerates and sedimentation and serve to maintain the colorant material in stable suspension without flocculation. A further function of the dispersant is to suppress the deposition of deposits in the background or nonimage areas of the imaging surface. The dispersant is generally miscible with the developer liquid in order to provide an integral developer wherein during development, there is no phase separation. The precise mechanism by which the dispersant inhibits the deposition of background deposits is not fully understood. It is clear, however, that in the absence of the presence of a dispersant, considerable background is usually present. Any suitable dispersant may be employed that is miscible with the developer vehicle. Typical dispersants providing the dual function of dispersing the solid colorant particles and suppressing background include alkylated polyvinyl pyrrolidones and copolymers of alkyl vinyl ethers and maleic anhydride. Typical alkylated polyvinyl pyrrolidones include those wherein there is at least about one alkyl substitution for each monomer unit, the substitution generally being in the pyrrolidone moiety and wherein the alkyl substituent has a carbon chain length of from about 10 to about 20 carbon atoms. Also included are polymers containing both nonalkylated and alkylated polyvinyl pyrrolidones, which may, for example, be prepared by copolymerizing mixtures of the alkylated and nonalkylated monomeric vinyl pyrrolidones. In these polymers the nonalkylated vinyl pyrrolidone units may be present in amounts up to about 80% of the total number of vinyl pyrrolidone units. Generally, these alkylated polyvinyl pyrrolidones have molecular weights of from about 5,000 to about 300,000. Typical specific materials include decalated polyvinyl pyrrolidone, dodecalated polyvinyl pyrrolidone, tridecalated polyvinyl pyrrolidone, tetradecalated polyvinyl pyrrolidone, pentadecalated polyvinyl pyrrolidone, hexadecalated polyvinyl pyrrolidone and octodecylated polyvinyl pyrrolidone.

In accordance with this invention, the resin to be used as the charge adjusting agent is generally a terpolymer of alkyl-methacrylate-styrene-vinyltriethoxy silane. As the alkyl group, it has been found that a methyl, ethyl, or butyl group provides satisfactory results concerning solubility and dispersibility. The copolymerization ratio of methacrylate:styrene may be optionally selected in the range of about 30:70 to about 90:10. The ratio of vinylalkoxy silane generally cannot be so high and is usually at most about 10% and preferably in the range of about 1 to 5%, all percentages being by weight. The ratio of polymerization usually has less influence and may be selected over a wider range. In general, the charge adjusting agents of this invention are the products of an addition polymerization reaction between monomers or prepolymers of (1) organo silanes, silanols, or siloxanes having from 1 to 3 hydrolyzable groups and an organic group attached directly to the silicon atom containing an unsaturated carbon to carbon linkage capable of addition polymerization; and (2) one or more silicon free types of unsaturated polymerizable organic compounds. The resinous polymers of this invention have a weight average molecular weight of at least about 5,000. Optimum results have been obtained with polymers having a weight average molecular weight ranging from about 50,000 to about 1,250,000. Preferably, the organo silicon constituent of the polymer should be present in an amount at from about 0.5% to about 50% by weight for maximum properties. The polymers may comprise random, block or graft copolymers, terpolymers, and high mixed polymer systems.

Excellent results are obtained with a charge adjusting agent containing the solid polymeric reaction product of monomers or prepolymers of (1) styrene; (2) acrylate or methacrylate esters; and (3) organo-silanes, silanols, or siloxanes having from 1 to 3 hydrolyzable groups and an organic group attached directly to the silicon atom containing an unsaturated carbon-to-carbon linkage capable of addition polymerization.

Preferably, the solid terpolymer should comprise from about 5 to about 94.5% by weight of a styrene composition; from about 94.5 to about 5% by weight of an acrylate or methacrylate ester; and from about 0.5 to about 50% by weight of the polymerizable organo silicon composition because optimum properties are obtained. However, satisfactory results are obtained with solid terpolymers comprising from about 0.5 to about 99% by weight of a styrene composition; from about 99 to about 0.5% by weight of an acrylate or methacrylate ester; and from about 0.5 to about 50% by weight of the polymerizable organo silicon composition. These reaction products have a weight average molecular weight of at least about 5,000. Optimum results are achieved with a terpolymer formed from the addition polymerization reaction between monomers or prepolymers of styrene, methylmethacrylate, and unsaturated organo silanes, silanols or siloxanes having from 1 to 3 hydrolyzable groups and an organic group attached directly to the silicon atom containing an unsaturated carbon-to-carbon linkage capable of addition polymerization. These reaction products have a weight average molecular weight of at least about 5,000. These polymers are preferred because they possess especially good triboelectric stability and excellent resistance to physical and chemical degradation. Good results are obtained with other addition reaction products of an unsaturated organo silicon compound and an unsaturated silicon-free compound.

The unsaturated organic group attached to a silicon atom contains the unsaturation in a non-benzoid group and is preferably an unsaturated hydrocarbon group or derivatives thereof. Typical unsaturated organic groups include: vinyl, chlorovinyl, divinyl, styryl, distyryl, allyl, diallyl, triallyl, allylphenyl, dimethallyl, and methacryloxypropyl groups and derivatives thereof. Typical hydrolyzable groups include: ethoxy, methoxy, chloro, bromo, propyloxy, acetoxy, and amino groups. Examples of typical unsaturated organo silanes having hydrolyzable groups attached to a silicon atom include: vinyltriethoxy silane, vinyltrimethoxy silane, vinyl-tris (beta-methoxyethoxy) silane, gamma-methacryloxypropyltrimethoxy silane, vinyl trichlorosilane, vinyl triacetoxy silane, divinyl dichloro silane, and dimethylvinylchloro silane. Suitable corresponding polymerizable hydrolysis products and the corresponding siloxanes may be substituted for the foregoing unsaturated organo silanes. If more than one organic group is attached to a silicon atom, only one of the organic groups need be unsaturated to enter into a polymerization reaction with other unsaturated monomers. Hence, compounds such as dimethyl vinyl chlorosilane are suitable. When more than one unsaturated group attached to the silicon atom is present, these unsaturated groups need not be identical. For example, vinyl allyl silicon chlorides and bromides may be employed. Partially condensed siloxanes in the liquid state having reactive unsaturated organic groups attached to a silicon atom may be employed as a component of the polymers of this invention.

Suitable silicon-free monomers or prepolymers with which the above organo silicon compounds are particularly adapted to react to form the charge adjusting agents of this invention include the unsaturated compounds which normally form resinous polymers by addition type polymerization. Monomers or prepolymers containing the unsaturation in a non-benzoid group may be employed, such unsaturated monomers or prepolymers include those having an ethylenic or acetylenic linkage. Thus, there are included olefins, diolefins, acetylenes and their derivatives, particularly derivatives having substituents such as halogen, alkyl, aryl, unsaturated alicyclic and other types of substituent groups including, for example, nitrile or nitro groups. The unsaturated organic monomers containing the unsaturation in a non-benzoid group also include unsaturated hydrocarbons, aliphatic, carbocyclic, and heterocyclic compounds including unsaturated alcohols, aldehydes, ketones, quinones, acids, acid anhydrides, esters, nitriles, or nitro compounds. Typical unsaturated monomers include: ethylene, propylene, butenes, isobutylene, pentenes, hexenes, methyl methacrylate, methyl acrylate, vinyl chloride, vinylidene chloride, acrylonitrile, chlorovinyl acetate, styrene, butadiene, chloroprene, cyclopentadiene, divinylbenzene, cyclohexadiene, ethyl methacrylate, vinyl acetate, vinyl toluene, acetylene, phenylacetylene, ethylvinyl benzene, allyl chloride, allyl benzene, maleic anhydride, ethyl acrylate, diethyl-maleate, butyl acrylate, butyl acrylate, butyl methacrylate, isobutyl methacrylate, methacrylic anhydride, vinyl formate, and mixtures thereof.

The polymerizable unsaturated monomers or prepolymers with any free-radical initiator or catalyst capable of polymerizing the monomers or prepolymers. By a "free-radical initiator or catalyst" is meant a compound which is capable of producing free-radicals under the polymerization conditions employed, such as compounds having an —O—O—or an —N=N—linkage. Examples of the more commonly employed free-radical initiators or catalysts include: alkyl peroxides, such as tert-butyl hydroperoxide, and di-tertbutyl peroxide; acyl and aroyl peroxides, as as di-benzoylperoxide, perbenzoic acid, dilauroyl peroxide, perlauric acid and acetyl benzoyl peroxide, azo compounds, such as azo-bis-isobutyro nitrile, dimethylazodiisobutyrate, azo-bis-1-phenylethane and alkali metal azo-disulfonates; and the like. In general, the free-radical initiators or catalysts are employed in an amount from about 0.0001 to about 5.0% based on the combined weight of the polymerizable ingredients.

The polymerization temperature to be employed is generally dependent on the batch size, the amount of catalyst present, the molecular weight to be attained, and the activation energy of the polymerization reaction. The rate of polymerization increases with an increase in temperature. Because greater exothermic reactions occur at high temperatures and increase the danger of uncontrollable reactions, high temperatures are preferably employed in processes where the heat of polymerization may be removed under controlled conditions, e.g., in jacketed tubes through which the polymerizable or partially polymerized material is continuously passed and in stirred kettles. The polymerization temperature employed is usually within the range of about 60°C to about the reflux temperatures of the monomer mixture at atmospheric pressure. However, economy and operating conditions such as the use of pressure or a vacuum may determine the use of higher or lower temperatures. Polymerization may be effectuated by suitable methods such as by bulk or solvent polymerization techniques. If a solvent is employed, it can be any suitable true organic solvent, i.e., a liquid unreactive to the system but capable of dissolving the reactive components. Typical well-known solvents include the chlorinated, ketone, ester, and hydrocarbon solvents such as, for example, xylene, benzene, toluene, hexane, cyclopentane, 1,1,1-trichloroethylene, ethyl acetate, methyl ethyl ketone, and the like.

The amount of charge adjusting agent to be employed in the liquid developer compositions of this invention is generally that which is at least sufficient to form a continuous coating on the colored marking particles because the coating will then possess sufficient thickness to provide the desired positive charge adjusting properties to the developer composition.

Exceptional dispersion of the pigment particles in the liquid developer accompanied by substantially no background deposition is obtained when the colorant particles have been previously mixed with a resin. This premixing of the colorant particles enables the liquid developer to be rapidly formed and facilitates the maintenance of a substantially uniform dispersion of the colorant particles in the liquid vehicle without the formation of agglomerates. The colored marking particles may be premixed with any suitable resinous material. The premixed marking particles may be employed in the liquid developer in any suitable amount. Typically, the premixed colorant particles contain from about 20 wt.% to about 50 wt.% of the colorant particle and from about 50 wt.% to about 80 wt.% resin all by weight of the premixed colorant particle. Superior dispersion of the colorant particles in the liquid developer over an extended period of time is obtained when the proportion of resin is from about 55 wt.% to about 70 wt.% by weight of the premixed colorant particle and the amount of the premixed colorant present in the liquid developer is from about 25 to about 50% by weight of the liquid developer.

As the resin component, which is soluble in the carrier solvent, there may be employed such resins as various vegetable oils, except caster oil, styrenated alkyd resins, vegetable oil modified alkyd resins, rosin modified alkyd resins, and rosin modified phenol formaldehyde resins.

Any suitable solid colorant material may be employed in the liquid developer compositions of this invention. There is no particular limit as to the coloring materials that may be used in the invention; generally all the materials that are insoluble in the carrier solvent may be employed. Even though a coloring material which generally provides a negative charge in the carrier solvent when used as a pigment alone such as Phthalocyanine Green, it can obtain a positive charge by coating its surface with the positive charge adjusting agent of this invention. To obtain image permanence, it is preferred that the colorant be fast to light. The solid colorant may be of any suitable size. Typically, the colored marking particles are from about 0.01 to about 10 microns in size. For superior image resolution, it is preferred that the colored marking particles be from about 0.1 microns to about 1 micron. Typical solid colorants include solid finely divided colored materials such as pigments, xerographic toners, and other marking particles. Typical pigments include carbon black, charcoal and other forms of finely divided carbon, quinacridones, phthalocyanine blues, iron oxide, ultramarine blues, zinc oxide, titanium dioxide, and benzidine yellow. Typical xerographic toners include finely divided thermoplastic resins or blends of thermoplastic resins in which pigments such as carbon black are dispersed.

The liquid developer compositions of the instant invention may be employed to develop an electrostatic latent image present on any suitable electrostatographic imaging surface. Basically, any surface upon which an electrostatic charge pattern may be formed or developed may be employed. Typical electrostatic imaging surfaces include dielectrics such as plastic coated papers, zero printing masters, and photoconductors. Typical photoconductors that may be employed include selenium and selenium alloys, cadmium sulfide, cadmium sulfoselenide, phthalocyanine binder coatings, polyvinylcarbazole sensitized with 2,4,7-trinitrofluorinone. The electrostatographic imaging surface may be employed in any suitable structure including plates, belts, or drums and may be employed in the form of a binder layer coated on a substrate. The imaging surfaces may be overcoated with suitable dielectric materials in conventional manner. Development of electrostatic latent images may be obtained by positioning an applicator surface with liquid developer thereon adjacent to the electrostatographic imaging surface. Any suitable applicator surface may be employed. Typical applicator surfaces include, among others, porous ceramics, metallic sponge, patterned webs or belts, capillary combs, and cylindrical rolls having surface patterns such as single screw cuts or trihelecoid, pyramidal, or quadrugravure indentations.

The applicator surface may be loaded with developer in any suitable manner. Typical developer loading techniques include applying developer from a roll or sponge roll or immersing the applicator in a bath. Prior to contacting the imaging surface, the applicator surface should be wiped or "doctored" clean to remove substantially all liquid developer from the applicator surface. Any suitable means may be provided such as a doctoring device. Typical doctoring devices include scraper blades and squeegee rolls. The doctoring in addition to removing liquid developer from raised portions of an applicator surface preferably provides a slight wiping action of the liquid developer in recessed portions of the applicator surface to thereby maintain the level of the liquid developer in the recessed portions slightly below the level of the raised portions. Such a loading of developer on an applicator surface minimizes deposits in the non-image areas.

DESCRIPTION OF THE PREFERRED EMBODIMENTS

The following preferred non-limiting examples further define, describe, and compare preferred materials and techniques of the present invention. In the examples, all parts and percentages are by weight unless otherwise specified.

EXAMPLE I

A photosensitive layer was prepared from a composition comprising about 120 grams of photoconductive zinc oxide, about 36 grams of the copolymer of vinyl chloride and vinyl acetate, about 4 grams of ethylphtharyl glycolate, about 35 cc of toluene, and about 25 cc of butyl acetate. The composition was kneaded for about 20 hours in a ball mill. The viscosity of the composition was adjusted with butyl acetate and the mixture was applied to paper treated by an electroconductive process employing a percolator so as to obtain a dry thickness of about 8 microns. After drying sufficiently, the photoconductive layer was subjected to dark adaptation by allowing to stand in a dark place for about 20 hours at about 40°C. The photosensitive layer prepared as described above was then exposed to corona discharge of about −7,000 volts to obtain a surface potential of about −450 volts. The charged photosensitive layer was then exposed to a light source having a color temperature of about 2,000° Kelvin for about 5 seconds through a positive original having a continuous-tone image. The maximum illuminance on the surface of the photosensitive layer was about 5,500 lux. After exposing, the photosensitive layer was treated in kerosene for pre-bath treatment and then put in the bath of the following liquid developer.

The following composition was kneaded for about 40 hours in a ball mill:

| | |
|---|---|
| Carbon black | 2 grams |
| Terpolymer of methylmethacrylate-styrene-vinyl triethoxy silane copolymerization ratio = 50:45:5) | 2 grams |
| Styrenated alkyd resin | 4 grams |
| Toluene | 50 cc |

One part of the resulting black paste was added to the following solvent mixture with a supersonic dispersing apparatus:

| | |
|---|---|
| Cyclohexane | 75 parts |
| Kerosene | 20 parts |
| Linseed oil | 5 parts |

After addition of the paste to the solvent mixture, the paste was dispersed for about 10 minutes with supersonic dispersion and the resulting black liquid developer was packed in a closed bottle for preservation. The photosensitive layer prepared as described above was developed with the aforementioned liquid developer composition and an excellent positive image was obtained. The photosensitive layer wetted with the liquid developer was meshed in an isoparaffin solvent, dried, and fixed by heating.

EXAMPLE II

The following composition was mixed by high speed agitation.

| | |
|---|---|
| Microris Blue 4G-T | 200 mg |
| Terpolymer of butylmethacrylate-styrene-vinyl triethoxy silane (copolymerization ratio = 60:30:10) | 200 mg |
| Styrenated alkyd resin | 500 mg |
| Toluene | 10 cc |

Microris Blue 4G-T is a product of Chiba. The pigment is coated with a hydrogenated rosin ester by flushing. The hydrogenated rosin ester is soluble in the carrier liquid. The thus obtained blue paste was dispersed in the following solvent mixture:

| | |
|---|---|
| Cyclohexane | 75 parts |
| Kerosene | 20 parts |
| Linseed oil | 5 parts |

The photosensitive layer of Example I bearing an electrostatic latent image was treated with the liquid developer composition described herein and a clear blue positive image was obtained.

EXAMPLE III

The following composition was kneaded in a ball mill:

| | |
|---|---|
| Phthalocyanine Green | 2 grams |
| Terpolymer of methylmethacrylate-styrene-vinyl triethoxy silane (copolymerization ratio = 80:15:5) | 2 grams |
| Soybean oil modified alkyl resin (oil length 65%) | 4 grams |
| Toluene | 50 cc |

One part of the thus obtained green paste was dispersed in the following solvent mixture:

| | |
|---|---|
| Cyclohexane | 40 parts |
| Kerosene | 55 parts |
| Linseed oil | 5 parts |

The photosensitive layer of Example I bearing an electrostatic latent image was treated with the thus obtained green liquid developer and a clear green positive image was obtained. It is to be noted that in the absence of the terpolymer, Phthalocyanine Green gave a negative charge to produce a negative image.

EXAMPLE IV

The terpolymer of ethylmethacrylate-styrene-vinyltriethoxy silane was used in place of the terpolymer of methyl-methacrylate-styrene-vinyltriethoxy silane of Example III and treatment similar to that described in Example III was performed to obtain similar results to that described in Example III.

Although the present examples were specific in terms of conditions and materials used, any of the above listed typical materials may be substituted when suitable in the above examples with similar results. In addition to the steps used to carry out the process of the present invention, other steps or modifications may be used if desirable. In addition, other materials may be incorporated in the system of the present invention which will enhance, synergize, or otherwise desirably affect the properties of the systems for their present use.

Anyone skilled in the art will have other modifications occur to him based on the teachings of the present invention. These modifications are intended to be encompassed within the scope of this invention.

What is claimed is:

1. A method of developing a recording surface bearing an electrostatic latent image comprising contacting said recording surface with a liquid developer composition consisting essentially of finely-divided colored marking particles substantially homogenously dispersed in a carrier liquid, said colored marking particles being substantially completely covered with a positive charge adjusting agent which is substantially insoluble in said carrier liquid, said charge adjusting agent consisting essentially of a solid terpolymer of (1) from about 5 to about 94.5% by weight of a polymerizable styrene composition, (2) from about 94.5 to about 5% by weight of a composition selected from the group consisting of polymerizable acrylate and methacrylate esters, and (3) from about 0.5 to about 50% by weight of a polymerizable organo silicone composition selected from the group consisting of organo silanes, silanols, and siloxanes having from 1 to 3 hydrolyzable groups and an organic group attached directly to a silicone atom containing an unsaturated carbon-to-carbon linkage, said terpolymer having a weight average molecular weight of at least about 5,000, until at least a portion of said finely-divided colored marking particles deposit on said recording surface in conformance to said electrostatic latent image.

2. A method of developing a recording surface bearing an electrostatic latent image in accordance with claim 1 wherein said terpolymer consists essentially of styrene-alkyl methacrylate-vinyltriethoxysilane.

3. A method of developing a recording surface bearing an electrostatic latent image in accordance with claim 1 wherein said colored marking particles have an average particle size from between about 0.01 to about 10 microns.

4. A method of developing a recording surface bearing an electrostatic latent image in accordance with claim 1 wherein the amount of said charge adjusting agent is at least sufficient to form a continuous coating on said colored marking particles.

5. A method of developing a recording surface bearing an electrostatic latent image in accordance with claim 1 wherein said colored marking particles consist essentially of a pigment predispersed in a resin.

6. A method of developing a recording surface bearing an electrostatic latent image in accordance with claim 1 wherein said liquid developer composition is substantially free of particle agglomeration.

7. A method of developing a recording surface bearing an electrostatic latent image comprising contacting said recording surface with a liquid developer composition consisting essentially of finely-divided colored marking particles substantially homogenously dispersed in a carrier liquid, said colored marking particles being substantially completely covered with a positive charge adjusting agent which is substantially insoluble in said carrier liquid, said charge adjusting agent consisting essentially of a solid polymeric addition reaction product of (1) from about 99.5 to about 50% by weight of a polymerizable styrene composition and a composition selected from the group consisting of polymerizable acrylate and methacrylate esters, and (2) from about 0.5 to about 50% by weight of a polymerizable organo silicone composition selected from the group consisting of silanes, silanols, and siloxanes having from 1 to 3 hydrolyzable groups and an organic group attached directly to a silicone atom containing an unsaturated carbon-to-carbon linkage, said solid polymeric addition reaction product having a weight average molecular weight of at least about 5,000, until at least a portion of said finely-divided colored marking particles deposit on said recording surface in conformance to said electrostatic latent image.

8. A method of developing a recording surface bearing an electrostatic latent image in accordance with claim 7 wherein said polymeric addition reaction product is a copolymer.

9. A method of developing a recording surface bearing an electrostatic latent image comprising contacting said recording surface with a liquid developer composition consisting essentially of finely-divided colored marking particles substantially homogenously dispersed in a carrier liquid, said colored marking particles being substantially completely covered with a positive charge adjusting agent which is substantially insoluble in said carrier liquid, said charge adjusting agent consisting essentially of a solid terpolymer of (1) from about 5 to about 94.5% by weight of a polymerizable styrene composition, (2) from about 94.5 to about 5% by weight of a polymerizable methacrylate composition selected from the group consisting of methyl, propyl, ethyl, and butyl methacrylates, and (3) from about 0.5 to about 50% by weight of a polymerizable organo silicone composition selected from the group consisting of silanes, silanols, and siloxanes having from 1 to 3 hydrolyzable groups and an organic group attached directly to a silicone atom containing an unsaturated carbon-to-carbon linkage, said solid terpolymer having a weight-average molecular weight of at least about 5,000, until at least a portion of said finely-divided colored marking particles deposit on said recording surface in conformance to said electrostatic latent image.

10. A process of developing a recording surface bearing an electrostatic latent image in accordance with claim 9 wherein said carrier liquid has an electrical resistance greater than about $10^{10}$ ohms-cm and a dielectric constant less than about 3.5.

* * * * *